US006698988B2

(12) United States Patent
Hoffman

(10) Patent No.: US 6,698,988 B2
(45) Date of Patent: Mar. 2, 2004

(54) SYSTEM AND METHOD FOR BUILDING MULTIPLE EDGES OF A CALENDAR

(75) Inventor: William M. Hoffman, Hamilton, OH (US)

(73) Assignee: Stuebing Automatic Machine Company, Cincinnati, OH (US)

( * ) Notice: Subject to any disclaimer, the term of this patent is extended or adjusted under 35 U.S.C. 154(b) by 106 days.

(21) Appl. No.: 10/136,775

(22) Filed: May 3, 2002

(65) Prior Publication Data

US 2002/0164230 A1 Nov. 7, 2002

Related U.S. Application Data

(60) Provisional application No. 60/288,766, filed on May 4, 2001.

(51) Int. Cl.[7] ..... B42D 5/00

(52) U.S. Cl. ..... 412/33; 40/107; 283/2; 412/9; 412/22; 412/34

(58) Field of Search ..... 283/2; 40/107; 412/9, 16, 17, 18, 19, 20, 22, 33, 34, 37; 493/438, 439, 443, 446, 455

(56) References Cited

U.S. PATENT DOCUMENTS

| | | | | |
|---|---|---|---|---|
| 1,906,024 A | | 4/1933 | Todd | |
| 2,042,912 A | | 6/1936 | Stuebing, Jr. | 153/1 |
| 3,826,227 A | * | 7/1974 | Allison | 118/60 |
| 4,151,037 A | * | 4/1979 | Klingelhoefer et al. | 156/468 |
| 4,208,750 A | * | 6/1980 | Pfaffle | 412/7 |
| 5,599,045 A | * | 2/1997 | Asai et al. | 281/21.1 |
| 5,707,194 A | | 1/1998 | Blumberg et al. | 412/38 |
| 6,042,319 A | | 3/2000 | Hoffman | 412/34 |
| 6,158,597 A | * | 12/2000 | McDermott | 211/45 |
| 6,182,938 B1 | * | 2/2001 | Wright | 248/468 |

FOREIGN PATENT DOCUMENTS

JP 2000351288 * 12/2000

OTHER PUBLICATIONS

Stuebing Automatic Machine Co., *The Stuebing ACF–24 High Speed Automatic Calendar and Poster Binding Machine*, Brochure featuring Stuebing ACF–24 Model Metal Edger, 4 pp.

Stuebing Automatic Machine Co., *The New Mark II*, Brochure featuring Stuebing Calamatic Metal Edger (Model 24) and Stuebing AF–500 Automatic Calendar Feeder, 4 pp.

* cited by examiner

*Primary Examiner*—Monica S. Carter
(74) *Attorney, Agent, or Firm*—Wood, Herron & Evans, LLP

(57) ABSTRACT

Calendars, posters and the like have slides applied to spaced top and bottom edges in an efficient and cost effective manner without diminishing production output levels nor requiring operator manipulation and involvement. The system includes a first and a second semi-automatic or automatic tinner which are joined together by a conveyor or a similar apparatus for transferring each of the serially processed calendars, posters or the like. Each calendar is processed in the first tinner to have a slide applied to a first or top edge of the calendar or poster. Each one is then serially discharged from the first tinner onto a conveyor in which the leading edge of the calendar includes the slide. The conveyor automatically transfers and reorients each calendar to the second tinner so that upon entering the second tinner, the bottom or opposite edge without the slide is the leading edge. The second tinner applies a slide without operator involvement or manipulation. The calendars are then discharged from the second tinner for stacking and further processing.

23 Claims, 3 Drawing Sheets

SYSTEM AND METHOD FOR BUILDING MULTIPLE EDGES OF A CALENDAR

This application claims the benefit of provisional application 60/288,766 filed on May 4, 2001.

BACKGROUND OF THE INVENTION

This invention relates to document binders. More specifically, this invention relates to an improved system and method for binding multiple edges of calendars or similar items with slides.

Slides for binding a margin of a calendar, poster, and the like are known in the art. A slide is generally an elongate strip of metal which may be folded or crimped one or more times onto the margin of an item, such as a calendar or poster. The slide may have a tab attached at a midpoint thereof so that the item may be hung by the tab at a desired location, such as on a wall. Examples of slides are shown in U.S. Pat. Nos. 1,906,024 and 2,042,912, each of which are incorporated herein by reference in their entirety.

Attaching a slide to the margin or edge of a calendar, poster, or the like, is commonly referred to as "tinning". Tinning calendars is an economical means for finishing calendars that are commonly used by companies for advertising purposes. Also, it is advantageous to tin other hanging documents, such as posters, maps, and training guides, so that they may hang neatly and be easily moved from one location to another.

In many situations, it is desirable to tin both the bottom and top edges of a calendar, poster or other item. The slide along the top edge of the item generally includes a tab or hook for hanging, while the slide along the bottom edge of the item does not generally include a tab. The slide provided along the bottom edge acts as an anchor, or weight, whereby the calendar or poster will hang flatly when mounted on a wall or other support. Because calendars are commonly used as promotional items and are shipped in a rolled configuration within a tube, the bottom slide advantageously helps to overcome the curl inherently induced in a calendar from being stored or shipped in a rolled configuration, once the calendar is removed from the tube Another advantage of having slides on both the top and bottom edges of a calendar is the ease with which such calendars may be handled in a stack. The edge of a calendar with a slide is typically much thicker than the remainder of the calendar. Thus, when dozens or hundreds of calendars having only a single tinned edge are stacked one upon another in a similar orientation, the portion of the stack corresponding to the tinned edges of the calendars is significantly higher than the untinned portion, thereby producing an uneven stack which is difficult to maneuver, ship or handle. One possible solution to this problem is to alternate the orientation of successive calendars, but this requires manipulation of at least fifty percent of the calendars and introduces further inefficiency into the production process. In contrast, a supply of calendars having slides on both the top and bottom edges can be stacked more neatly and without requiring reorientation of the calendars in the stack.

Certain prior art machines for tinning have been fully automatic or semi-automatic so that large numbers of slides per hour may be applied to individual calendars. One such tinner is shown in U.S. Pat. No. 5,707,194 which is hereby incorporated by reference in its entirety. The '194 patent shows a calendar tinner which automatically supplies a metal strip from a roll of metal to a first folding mechanism which automatically folds the metal strip longitudinally. A calendar then is automatically fed into the folded metal strip, whereafter the metal strip is cut to the width of the calendar to form the slide. The slide is then automatically crimped upon the calendar to sandwich the calendar therein. Thereafter, the slide is automatically folded a second time to produce a second bend which is then automatically crimped back upon itself to complete the tinning process.

Other automatic and semi-automatic tinners are also available from the assignee of this invention. The Stuebing Automatic Machine Company provides, for example, the Calamatic Metal Edger into which a calender is fed either manually or automatically and the edger automatically crimps the slide upon the calendar. Also, the Stuebing ACF-24 or ACF-32 systems automatically feed the slides and calendars and crimp a slide to each calendar. Machines of this type can tin over 20,000 slides per eight-hour shift and are generally used by those who wish to tin large volumes of materials.

Such automatic or semi-automatic machines are intended for large capacity production. Nevertheless, tinning both the top and bottom edges of a calendar requires processing each calendar twice through the tinner. As a result, overall production volume is typically cut in half. This inefficiency is highlighted during peak calendar production periods. Calendars are typically seasonal items and producers or suppliers must meet demands in a timely fashion. Therefore, an inefficiency which reduces production by fifty percent during such peak demand periods is even more problematic. Moreover, increased labor costs often require that the tinning process be conducted by a single operator for efficient and economical production of calendars, posters and the like.

Therefore, a need exists for a system and associated method for efficiently and effectively tinning multiple edges of calendars, posters, or other items in an economical and acceptable manner for mass production without detrimentally impacting the quantity or quality of output or increasing labor requirements.

SUMMARY OF THE INVENTION

These and other objectives of the invention are achieved with an improved system and method for tinning top and bottom edges of an item, such as a calendar, poster, or the like, while still maintaining desired production output levels. In an exemplary embodiment of the invention, the system includes two automatic or semi-automatic tinners, such as the Calamatic Metal Edger, ACF-24 or ACF-32 systems, each commercially available from the Stuebing Automatic Machine Company in Cincinnati, Ohio. One tinner applies a slide to a first or top edge of each of a supply of items, such as calendars, posters, or the like. Each item is then serially discharged from the first tinner onto a conveyor or transferring apparatus. The leading edge of each item discharged from the first tinner has a slide. The conveyor system automatically transfers each of the items to a second tinner for automatically tinning the opposite or bottom edge of each item. Advantageously, the conveyor feeds each successive item to the second tinner in an orientation wherein the leading edge entering the second tinner is the bottom, or untinned edge, which requires the slide. Accordingly, operator involvement for the transfer of each item between the first and second tinners is not required to automatically process and tin the calendar on both the top and bottom edges thereof.

The present invention thus provides a system and associated method for automatically tinning spaced top and bottom edges of a calendar, poster or the like with state of the art semi-automatic and/or automatic tinners utilized in series with a conveyor for transferring and orienting each of the serially processed calendars, posters or the like between the two tinners. Advantageously, operator involvement is not required to process each of the calendars between the first and second tinners. Because each calendar is only processed once through the system, production output is not diminished and an operator is not required to collect each of the calendars after the first tinning operation, reorient each calendar, and input them into the second tinning machine for tinning on the opposite spaced edge thereof.

BRIEF DESCRIPTION OF THE DRAWINGS

The objectives and features of the invention will become more readily apparent from the following detailed description taken in conjunction with the accompanying drawings in which:

FIG. 1 is a plan view of an exemplary system for tinning top and bottom edges of a supply of serially fed items, such as calendars, posters, or the like;

DETAILED DESCRIPTION OF THE INVENTION

Figure 1:
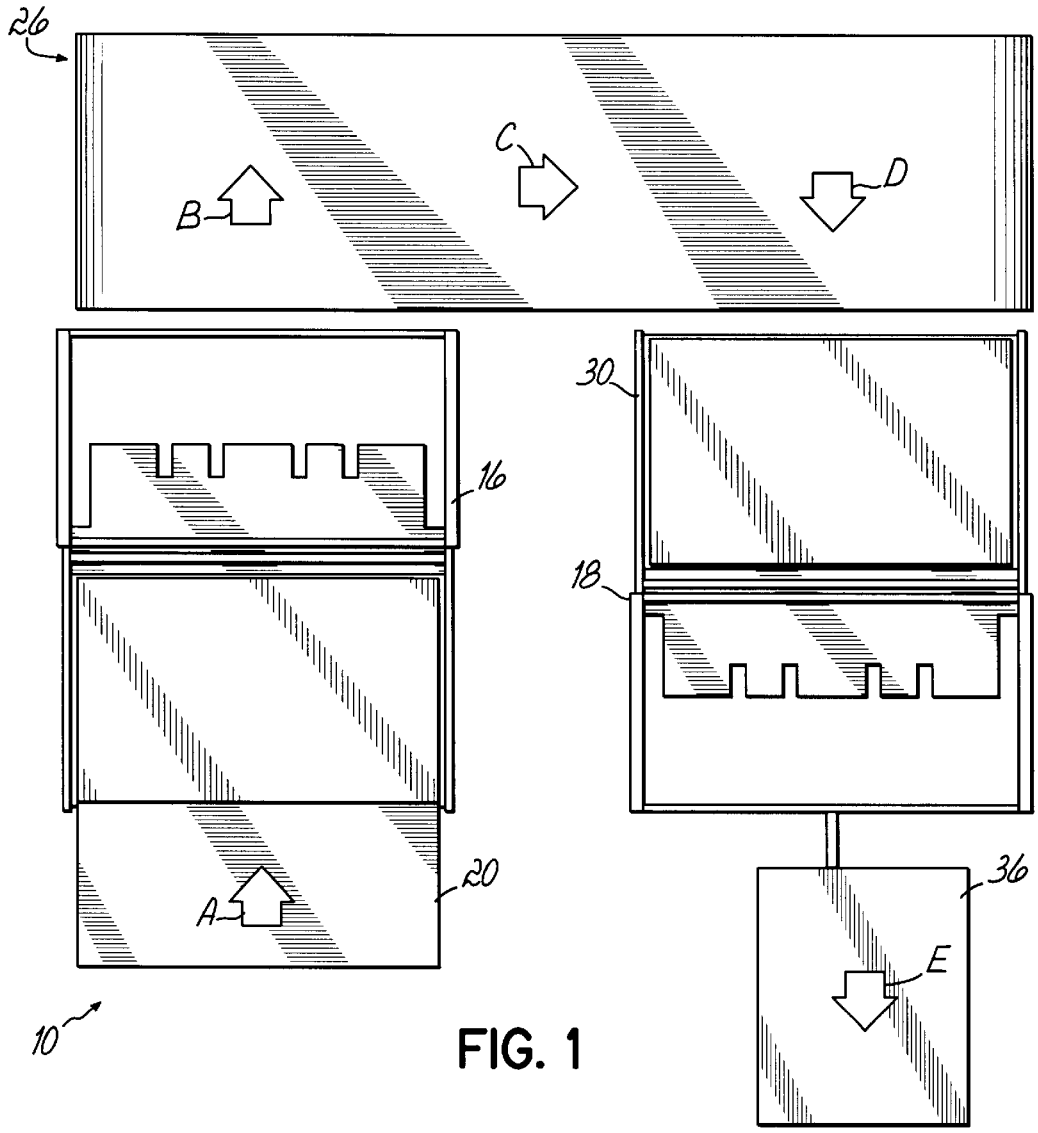

Referring to FIG. 1, a system 10 according to one exemplary embodiment of this invention for binding multiple edges of a calendar, poster, or other workpiece 14 is shown. While this invention is primarily intended for processing calendars, other articles for tinning may be processed, such as posters, maps, instructional guides or other similar items. Such items are generally referred to herein as workpieces 14.

The system 10 includes first and second tinning machines 16, 18. While any type of automatic or semi-automatic tinning machine may be utilized, most preferably the tinning machines 16, 18 employed in this invention are Calamatic Metal Edgers utilized in conjunction with AF-500 Automatic Calendar Feeders, each of which are commercially available from The Stuebing Automatic Machine Company of Cincinnati, Ohio. The Calamatic Metal Edger and the AF-500 Automatic Calendar Feeder are available in models appropriate for processing calendars up to 24 inches wide or 32 inches wide, as appropriate. Alternatively, the Stuebing ACF-24 or ACF-32 automatic binding machines may be utilized with this invention.

System 10 further includes first and second calendar feeders 20, 30 associated with the first and second tinning machines 16, 18, respectively. A conveyer 26 is positioned proximate the first and second tinning machines 16, 18 such that the conveyor 26 is adjacent the discharge end of the first tinning machine 16 and adjacent the infeed end of the second tinning machine 18. Flow of workpieces through the system 10 is such that the conveyor 26 is downstream from the first tinning machine 16 and upstream from the second tinning machine 18.

Figure 2:
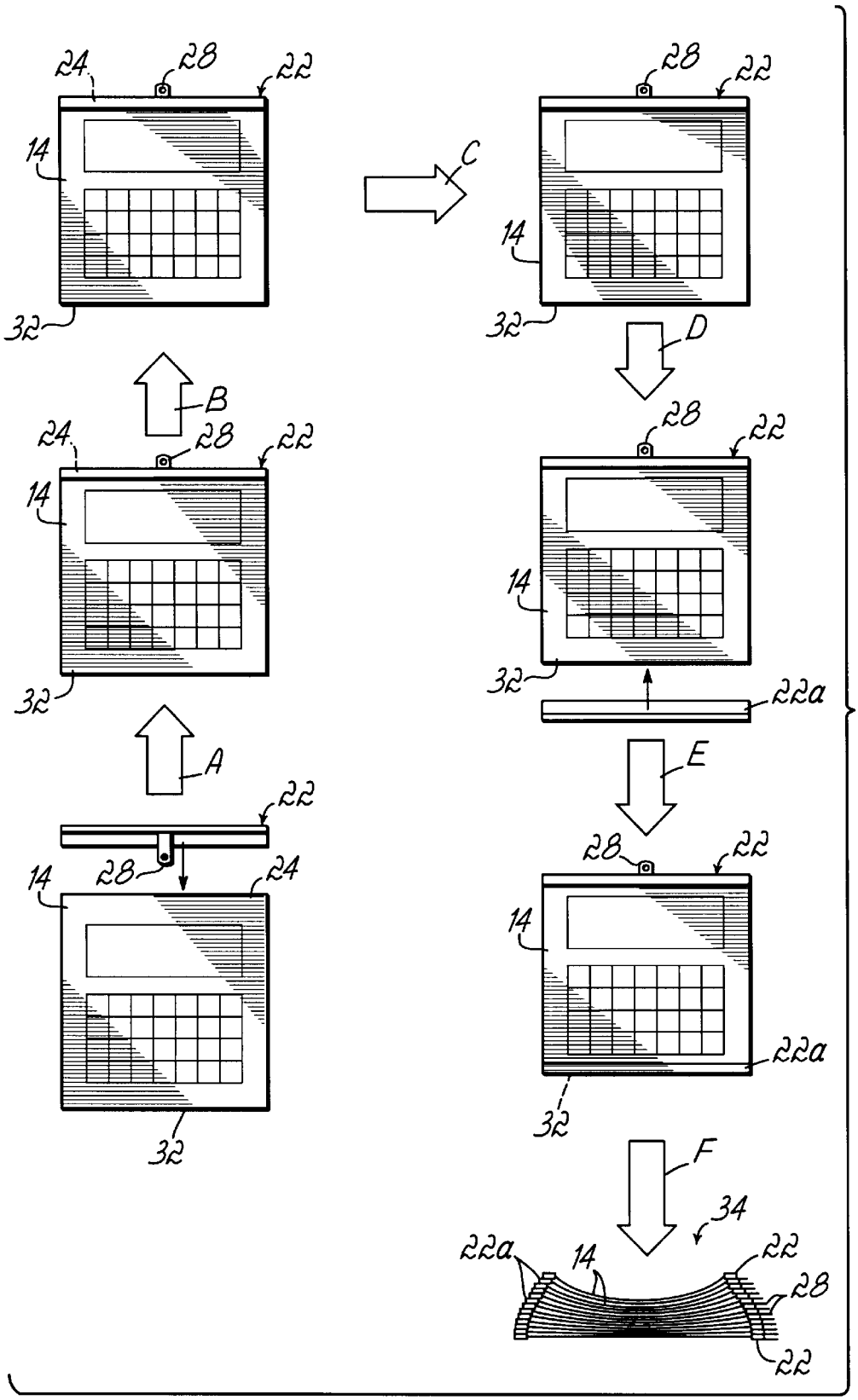
FIG. 2 is a schematic representation of the operations performed on a calendar being processed through the system of FIG. 1.

Referring further to FIG. 2, a supply of workpieces 14 is input (arrow A) into the first calendar feeder 20. The calendar feeder 20 feeds successive workpieces 14 for individual processing in the first tinning machine 16. Each workpiece 14 is fed to the first tinning machine 16 from the first feeder 20 such that a first edge 24 of the workpiece 14, typically the top edge, is the leading edge, and a slide 22 is applied to the first edge 24 of the workpiece 14. The workpieces 14 are serially and individually discharged from the first tinning machine 16, leading edge first, onto the conveyor or transferring apparatus 26, as shown by arrow B. As shown in FIG. 2, slide 22, applied to first (top) edge 24, may have a tab 28.

Conveyor 26 transfers each workpiece 14 laterally in the direction of arrow C for input into the second feeder 30 of second tinning machine 18 (arrow D). Advantageously, each workpiece 14 is transferred from the first tinning machine 16 to the second tinning machine 18 and is presented to the second tinning machine 18 by second feeder 30 in an orientation such that a second edge 32 of workpiece 14 is the leading edge with respect to second tinning machine 30. As such, the second edge 32 of each workpiece 14 entering the second tinning machine 18 does not have a slide 22*a* applied thereto.

Figure 3:
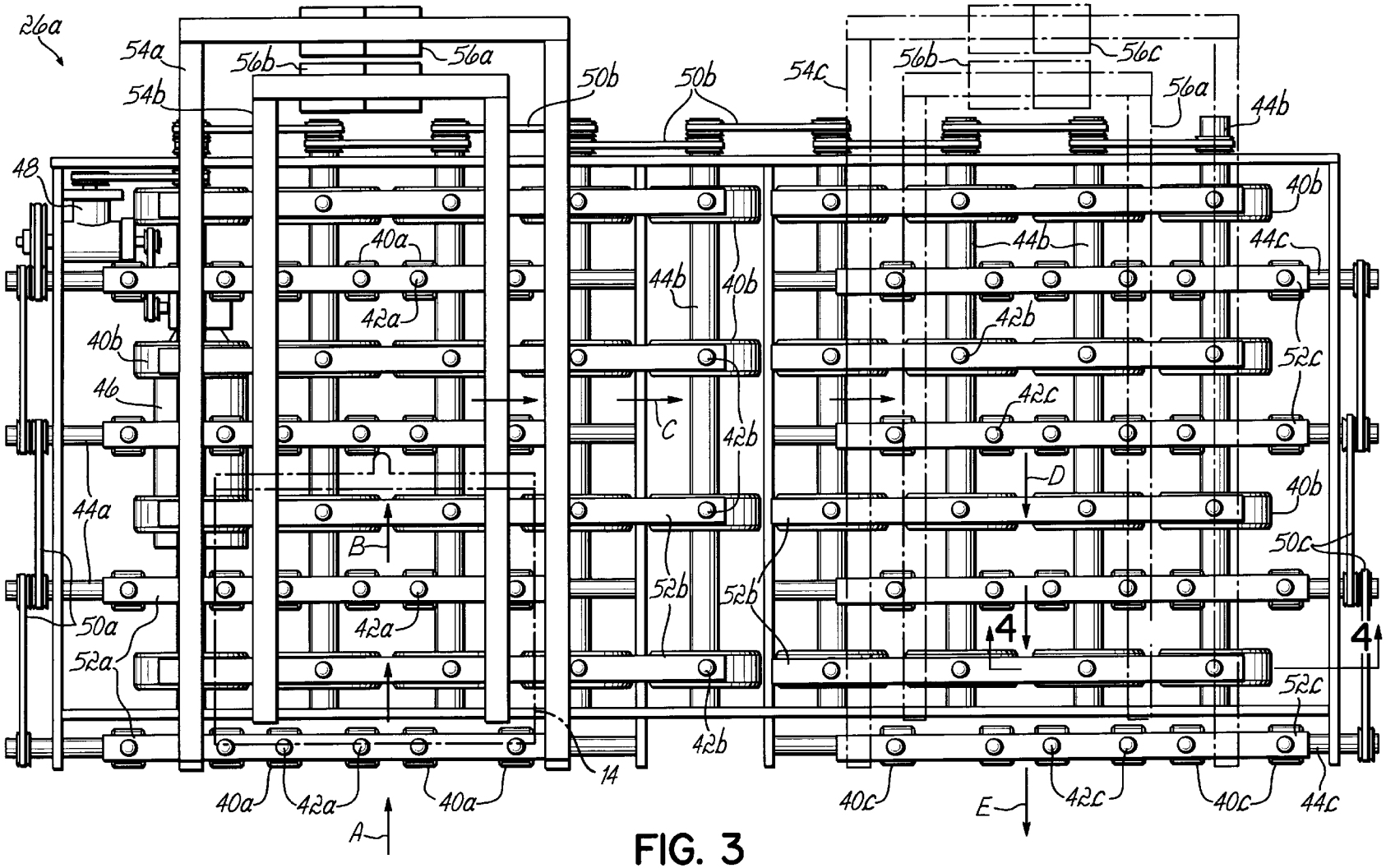
FIG. 3 is a plan view of an exemplary conveyor of the present invention.

Referring further to FIG. 3, an exemplary conveyor 26*a* will be described, wherein similar components are denoted with common reference numbers and distinguishing suffix letters (a, b, c). Suffix "a" refers to components which function to move a workpiece 14 along conveyor 26*a* in the direction of arrow B, in FIGS. 1–3. Likewise, suffixes "b" and "c" refer to components which function to move a workpiece 14 along the conveyor 26*a* in the directions of arrows C and D, respectively.

Exemplary conveyor 26*a* comprises an array of rollers 40*a*, 40*b*, 40*c* and bearings 42*a*, 42*b*, 42*c* configured to receive each workpiece 14 discharged from the first tinning machine 16 and to transfer the workpiece 14 for presentation to the second tinning machine 18. Rollers 40*a*, 40*b*, 40*c* are supported on respective shafts 44*a*, 44*b*, 44*c* and are driven by a motor 46 through a gearbox 48 and belts 50*a*, 50*b*, 50*c* attached between shafts 44*a*, 44*b*, 44*c*, respectively. Bearings 42*a*, 42*b*, 42*c* are supported above rollers 40*a*, 40*b*, 40*c* by elongate strips having apertures therein to capture the bearings 42*a*, 42*b*, 42*c*. Bearings 42*a*, 42*b*, 42*c* may freely rotate on the elongate strips 52*a*, 52*b*, 52*c* and are driven to rotate in a desired direction upon contact with respective rollers 40*a*, 40*b*, 40*c* to thereby impart motion to workpiece 14 supported above the bearings 42*a*, 42*b*, 42*c*.

In the exemplary embodiment shown, the elongate strips 52*a*, 52*b*, 52*c* are coupled to moveable frames 54*a*, 54*b*, 54*c* whereby the elongate strips 52*a*, 52*b*, 52*c* may be selectively moved relative to rollers 40*a*, 40*b*, 40*c* under the control of respective actuators 56*a*, 56*b*, 56*c* to bring bearings 42*a*, 42*b*, 42*c* into and out of contact with respective rollers 40*a*, 40*b*, 40*c*.

Figure 4:
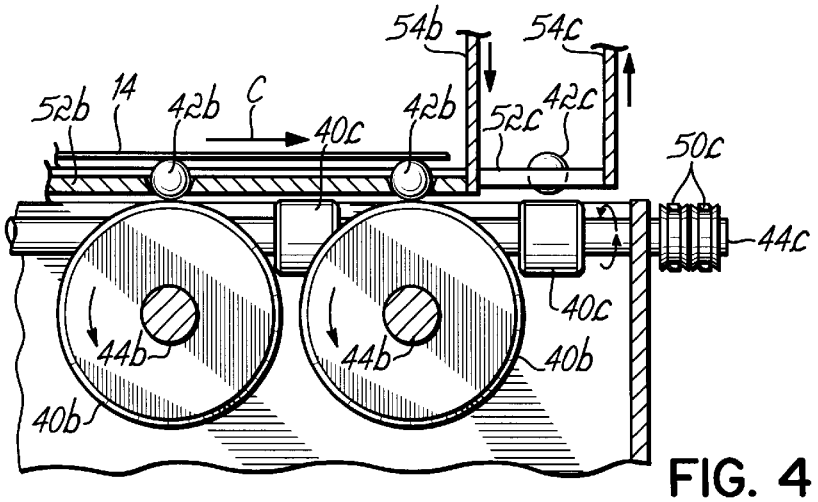
FIG. 4 is a partial section view taken along line 4—4 of FIG. 3.

FIG. 4 is a depicts a partial side view of the conveyor 26*a* and illustrates how frames 54*b*, 54*c* raise and lower strips 52*b*, 52*c* such that bearings 42*b*, 42*c* are brought into contact with, or are separated from respective rollers 40*b*, 40*c* to move workpiece 14 along conveyor 26*a* in the direction of arrow C. As shown in FIG. 4, bearings 42*b* are in contact with rollers 40*b*, whereby motion of rollers 40*b* drives bearings 42*b* to move workpiece 14 supported above the bearings 42*b*. Likewise, bearings 42*c* are separated from rollers 40*c* and do not impart motion to the workpiece 14.

In operation, a first set of bearings 42*a* draws each workpiece 14 onto conveyor 26*a* in the direction of arrow B. Actuator 56*a* moves bearings 42*a* away from rollers 40*a*, and actuators 56*b* move bearings 42*b* into contact with rollers 40*b* to advance the workpiece 14 along the conveyor

26*a* in the direction of arrow C. Actuators 56*b* then move bearings 42*b* away from rollers 40*b*, and actuator 56*c* moves bearings 42*c* into contact with rollers 40*c*, whereby the workpiece 14 is advanced toward the second feeder 30 and second tinning machine 18 in the direction of arrow D. As such, the conveyor 26*a* includes first, second and third transfer mechanisms that move the workpieces 14 in the directions of arrows B, C, and D, respectively.

Conveyor 26*a* may further include sensors (not shown) used in conjunction with the actuators 56*a*, 56*b*, 56*c* to maintain proper alignment of the workpiece 14 on the conveyor 26*a* and to facilitate manipulation of bearings 42*a*, 42*b*, 42*c* to advance the workpiece 14 as described above.

The second tinning machine 18 processes each workpiece 14 by applying a slide 22*a* to the second edge 32 of the workpiece 14, typically the bottom edge of workpiece 14. Upon exiting the second tinning machine 18, each workpiece 14 has two slides 22, 22*a* applied or crimped to the spaced opposite edges 24, 32 thereof. Each workpiece 14 is serially discharged from the second tinning machine 18 in the direction of arrow E for accumulation by a collector 36 into a stack 34 for convenient packaging, shipping or further processing.

Referring specifically to FIGS. 1 and 2, a method for tinning first and second edges 24, 32 of a workpiece 14 will be described. Initially, each workpiece 14 is fed in the direction of arrow A by first feeder 20 of the first tinning machine 16, which automatically applies or crimps a slide 22 to the first edge 24 of the workpiece 14. The workpiece 14 is then discharged from the first tinning machine 16 onto the conveyor 26 in the direction of arrow B and transferred in the direction of arrow C for input into second feeder 30 and second tinning machine 18. Workpiece 14 is fed into second tinning machine 30 in the direction of arrow D and in an orientation such that second edge 32 is the leading edge. Second tinning machine 18 applies second slide 22*a* to the second edge 32 of workpiece 14. Workpiece 14 is then discharged from the second tinning machine 18 in the direction of arrow E for stacking in stack 34 by collector 36. Therefore, the system 10 and method according to this invention, automatically processes a supply of workpieces 14 with slides 22, 22*a* applied to multiple edges 24, 32 without requiring operator involvement.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A system for crimping first and second slides onto first and second edges, respectively, of each of a series of workpieces, the system comprising:

a first tinning machine adapted to crimp one of the first slides onto the first edge of each workpiece;

a second tinning machine located downstream from the first tinning machine and adapted to crimp one of the second slides onto the second edge of each workpiece; and a conveyor located downstream from the first tinning machine and upstream from the second tinning machine and configured to receive each of the workpieces from said first tinning machine and transfer each of the workpieces to said second tinning machine.

2. The system of claim 1 wherein said first tinning machine receives each workpiece oriented such that the first edge is a leading edge, and said conveyor reorients each workpiece so that the second tinning machine receives each workpiece oriented such that the second edge is the leading edge.

3. The system of claim 2 wherein the conveyor is generally U-shaped.

4. The system of claim 1 further comprising a collector downstream of said second tinning machine, said collector adapted to collect and stack the workpieces upon one another.

5. The system of claim 4, wherein said collector stacks each workpiece to have the same orientation relative to one another.

6. The system of claim 1 wherein the conveyor further comprises:

first, second and third transfer mechanisms for moving the workpieces in first, second and third directions, respectively.

7. The system of claim 6 wherein the first, second and third transfer mechanisms are serially arranged.

8. The system of claim 7 wherein the first and second directions are generally parallel and oppositely oriented and the third direction is generally perpendicular to the first and second directions.

9. The system of claim 6 wherein each transfer mechanism further comprises:

a plurality of bearings mounted for rotation;

a plurality of rotationally driven rollers; and a frame coupled to the bearings to selectively engage the bearings with the rollers to thereby rotate the rollers and transfer the workpieces in one of the first, second and third directions.

10. The system of claim 9 further comprising:

an actuator to selectively move the frame relative to the rollers for engagement and disengagement of the bearings with the rollers.

11. The system of claim 9 further comprising:

a plurality of strips; and a plurality of apertures in each of the strips;

wherein each of the strips is coupled to the frame and each of the bearings is captured in one of the apertures.

12. The system of claim 1 wherein the conveyor does not require operator handling of the workpieces for transfer from the first tinning machine to the second tinning machine.

13. A system for crimping first and second slides onto first and second edges, respectively, of each of a series of workpieces, the system comprising:

a first tinning machine adapted to crimp one of the first slides onto the first edge of each workpiece;

a second tinning machine located downstream from the first tinning machine and adapted to crimp one of the second slides onto the second edge of each workpiece;

a generally U-shaped conveyor located downstream from the first tinning machine and upstream from the second tinning machine and configured to receive each of the workpieces from said first tinning machine and transfer each of the workpieces to said second tinning machine;

wherein said first tinning machine receives each workpiece oriented such that the first edge is a leading edge, and said conveyor reorients each workpiece so that the second tinning machine receives each workpiece oriented such that the second edge is the leading edge;

a collector downstream of said second tinning machine, said collector adapted to collect and stack the workpieces upon one another.

14. The system of claim 13 wherein the conveyor further comprises:

first, second and third transfer mechanisms for moving the workpieces in first, second and third directions, respectively.

15. The system of claim 14 wherein the first, second and third transfer mechanisms are serially arranged.

16. The system of claim 15 wherein the first and second directions are generally parallel and oppositely oriented and the third direction is generally perpendicular to the first and second directions.

17. The system of claim 16 wherein each transfer mechanism further comprises:

a plurality of bearings mounted for rotation;

a plurality of rotationally driven rollers;

a frame coupled to the bearings to selectively engage the bearings with the rollers to thereby rotate the rollers and transfer the workpieces in one of the first, second and third directions; and an actuator to selectively move the frame relative to the rollers for engagement and disengagement of the bearings with the rollers.

18. The system of claim 17 further comprising:

a plurality of strips; and a plurality of apertures in each of the strips;

wherein each of the strips is coupled to the frame and each of the bearings is captured in one of the apertures.

19. A method for crimping a first and a second slide onto a first and a second edge, respectively, of each of a series of workpieces, the method comprising the steps of:

positioning the first slide proximate the first edge of one of the workpieces;

crimping the first slide onto the first edge of the workpiece at a first crimping station;

automatically transferring the workpiece to a second crimping station;

positioning the second slide proximate the second edge; and crimping the second slide onto the second edge.

20. The method of claim 19 further comprising:

reorienting the workpiece prior to positioning the second slide proximate the second edge of the workpiece.

21. The method of claim 20 wherein the reorienting step results in the first edge being a leading edge of the workpiece at the first crimping station and the second edge being the leading edge at the second crimping station.

22. The method of claim 19 further comprising:

serially discharging each of the workpieces from the second crimping station; and stacking each of the discharged workpieces with other discharged workpieces.

23. The method of claim 22 wherein the stacking further comprises:

similarly orienting each of the discharged workpieces.

* * * * *

UNITED STATES PATENT AND TRADEMARK OFFICE

CERTIFICATE OF CORRECTION

PATENT NO. : 6,698,988 B2
DATED : March 2, 2004
INVENTOR(S) : William H. Hoffman It is certified that error appears in the above-identified patent and that said Letters Patent is hereby corrected as shown below:

Title page, Item [54] and Column 1, line 1,
Title, "METHOD FOR BUILDING" should read -- METHOD FOR BINDING --.

Signed and Sealed this

First Day of June, 2004

JON W. DUDAS
*Acting Director of the United States Patent and Trademark Office*